US006918824B2

(12) United States Patent
Marquardt et al.

(10) Patent No.: US 6,918,824 B2
(45) Date of Patent: Jul. 19, 2005

(54) UNIFORM FLUID DISTRIBUTION AND EXHAUST SYSTEM FOR A CHEMICAL-MECHANICAL PLANARIZATION DEVICE

(75) Inventors: Dave Marquardt, Phoenix, AZ (US); Sooyun Joh, Livermore, CA (US); David Cohen, San Jose, CA (US); Edward J. McInerney, San Jose, CA (US)

(73) Assignee: Novellus Systems, Inc., San Jose, CA (US)

( * ) Notice: Subject to any disclaimer, the term of this patent is extended or adjusted under 35 U.S.C. 154(b) by 49 days.

(21) Appl. No.: 10/671,841

(22) Filed: Sep. 25, 2003

(65) Prior Publication Data

US 2005/0070214 A1 Mar. 31, 2005

(51) Int. Cl.[7] ..... B24B 5/00

(52) U.S. Cl. ..... 451/285; 451/527; 451/528; 451/529

(58) Field of Search ..... 451/527, 528, 451/529, 285–289

(56) References Cited

U.S. PATENT DOCUMENTS 5,489,233 A 2/1996 Cook et al.
5,725,420 A * 3/1998 Torii ..... 451/285
5,888,121 A * 3/1999 Kirchner et al. ..... 451/41
5,921,855 A 7/1999 Osterheld et al.
6,056,851 A * 5/2000 Hsieh et al. ..... 156/345.12
6,159,088 A * 12/2000 Nakajima ..... 451/527
6,241,596 B1 6/2001 Osterheld et al.
6,273,806 B1 8/2001 Bennett et al.
6,488,570 B1 * 12/2002 James et al. ..... 451/36
6,520,847 B2 2/2003 Osterheld et al.
2002/0187735 A1 * 12/2002 Nabeya ..... 451/67

* cited by examiner

*Primary Examiner*—M. Rachuba
(74) *Attorney, Agent, or Firm*—Ingrassia Fisher & Lorenz PC

(57) ABSTRACT

An assembly for a chemical-mechanical polishing process includes a platen having an outer edge, a top surface, and at least one inlet for introducing fluid to the top surface; a manifold system, entrenched in the top surface and in communication with the at least one inlet, for channeling the fluid about the top surface; a polishing pad having a top pad surface, and a plurality of fluid delivery through-holes for introducing the fluid from the manifold system to the top pad surface; and a fluid distribution system, entrenched in the top pad surface and in communication with the through-holes, for substantially uniformly distributing the fluid about the top pad surface. The fluid distribution system includes a set of intersecting first grooves defining an array of lands, each of the first grooves having a first cross sectional area. The fluid distribution system also includes a plurality of second grooves disposed within each of the lands and communicating with the first grooves, each of the second grooves having a second cross sectional area that is smaller than the first cross sectional area.

24 Claims, 8 Drawing Sheets

UNIFORM FLUID DISTRIBUTION AND EXHAUST SYSTEM FOR A CHEMICAL-MECHANICAL PLANARIZATION DEVICE

FIELD OF THE INVENTION

The present invention relates to chemical-mechanical polishing devices. More particularly, the present invention relates to wafer planarization enhancement through improved slurry distribution on a polishing pad.

BACKGROUND

Chemical-mechanical polishing (CMP) is the process of removing projections and other imperfections from a semiconductor wafer to create a smooth planar surface. The wafer is the basic substrate material in the semiconductor industry for the manufacture of integrated circuits. Wafers are typically created by growing an elongated cylinder or boule of single crystal silicon and then slicing individual wafers from the cylinder. Slicing causes both faces of the wafer to be somewhat rough. Planarization is desirable because the front face of the wafer on which integrated circuitry is to be constructed must be substantially flat in order to facilitate reliable semiconductor junctions with subsequent layers of material applied to the wafer. Composite thin film layers comprising metals for conductors or oxides for insulators must also be made of a uniform thickness if they are to be joined to the semiconductor wafers or to other composite thin film layers.

Planarization is typically completed before performing lithographic processing steps that create integrated circuitry or interconnects on the wafer. Non-planar surfaces result in poor optical resolution of subsequent photolithographic processing steps which in turn hinders high-density features from being adequately printed. If a metallization step height is too large, open circuits will likely be created. Consequently, CMP tools are continually being improved upon with an aim toward controlling wafer planarization.

In a conventional CMP assembly the wafer is secured in a carrier connected to a shaft. The shaft is typically connected to a transporter that moves the carrier between a load or unload station and a position adjacent to a polishing pad. One side of the polishing pad has a polishing surface thereon, and an opposite side is mounted to a rigid platen. Pressure is exerted on a wafer back surface by the carrier in order to press a wafer front surface against the polishing pad. Polishing slurry is introduced onto the polishing surface while the wafer and/or polishing pad are moved in relation to each other by means of motors connected to the shaft and/or platen. One way that the slurry is supplied to the polishing surface is through one or more holes in the polishing pad. The holes in the polishing pad are in communication with a supply source via holes or passageways provided in the platen.

The above combination of chemical and mechanical stress results in removal of material from the wafer front surface in a planar manner. One requisite for removing wafer material at a high rate ("removal rate") and for forming a wafer with high surface uniformity is a uniform distribution of slurry about the polishing surface. FIGS. 1(A) and 1(B) depict one common polishing pad 10 that has a top surface characterized by a series of grooves 11 that are patterned as concentric arcs. FIG. 1(B) is a magnified view of the region surrounded by a rectangle in FIG. 1(A) for the purpose of better viewing the grooves 11. The grooves 11 shown in FIGS. 1(A) and 1(B) do not exactly represent the actual groove number and curvature for a conventional polishing pad, but are drawn to generally illustrate the conventional polishing pad groove configuration. The grooves 11 facilitate widespread slurry distribution across the polishing pad 10. The grooves 11 terminate at the polishing pad edge, and slurry that is forced off the edge is replaced by a continuing slurry supply.

The main driver in biasing the slurry flow toward the perimeter of a polishing pad is the pressure imbalance from the center to the edge of the pad. Slurry disposed at the pad center will have a highly resistive fluid path when compared to the fluid resistance path at the pad perimeter. The densely distributed grooves 11 in the polishing pad 10 depicted in FIG. 1 would ideally facilitate uniform slurry distribution. However, visualization experiments and virtual fluid modeling have shown that the pattern of concentric arcs causes the center of the pad 10 to be deprived of slurry and the perimeter of the pad 10 to be oversupplied.

One attempt at overcoming uneven slurry distribution across a pad included the addition of perpendicularly intersecting grooves 12 to the polishing pad 10 as depicted in FIG. 1. The grooves 12 were evenly spaced at a pitch of ¼ inch to 1 inch. This X-Y grid of grooves 12 improved the slurry distribution to some extent, although not entirely. The reason for uneven slurry distribution is evident when reviewing the pattern of the arced grooves 11 within a square in the X-Y grid. For example, in an actual polishing pad there are 17 grooves meeting the polishing pad edge and thereby facilitating the evacuation of slurry from the perimeter square segment marked "A." By comparing this to the square segments marked "B" and "C" where there are, respectively, 10 and 0 grooves facilitating the evacuation of slurry from the segments from the polishing pad edge, it is clear why slurry tends to flow away from certain areas and accumulate in other pad areas. Although the exact relationship between slurry distribution and CMP is not quantified, empirical evidence shows that slurry distribution has a direct impact on wafer non-uniformity and removal rate.

Accordingly, it is desirable to stabilize wafer removal rate during a CMP process and to improve wafer uniformity. In addition, it is desirable to accomplish these goals by providing a polishing pad that facilitates even distribution of slurry over the pad during a CMP process. Furthermore, other desirable features and characteristics of the present invention will become apparent from the subsequent detailed description and the appended claims, taken in conjunction with the accompanying drawings and the foregoing technical field and background.

BRIEF SUMMARY

An assembly is provided for a chemical-mechanical polishing process. The assembly includes four basic elements. First, the assembly includes a platen having an outer edge, a top surface, and at least one inlet for introducing fluid to the top surface. Second, the assembly includes a manifold system, entrenched in the top surface and in communication with the at least one inlet, for channeling the fluid about the top surface. Third, the assembly includes a polishing pad having a top pad surface, and a plurality of fluid delivery through-holes for introducing the fluid from the manifold system to the top pad surface. Fourth, the assembly includes a fluid distribution system, entrenched in the top pad surface and in communication with the through-holes, for substantially uniformly distributing the fluid about the top pad surface.

The fluid distribution system includes a set of intersecting first grooves defining an array of lands, each of the first grooves having a first cross sectional area. The fluid distribution system also includes a plurality of second grooves disposed within each of the lands and communicating with the first grooves, each of the second grooves having a second cross sectional area that is smaller than the first cross sectional area.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 2:
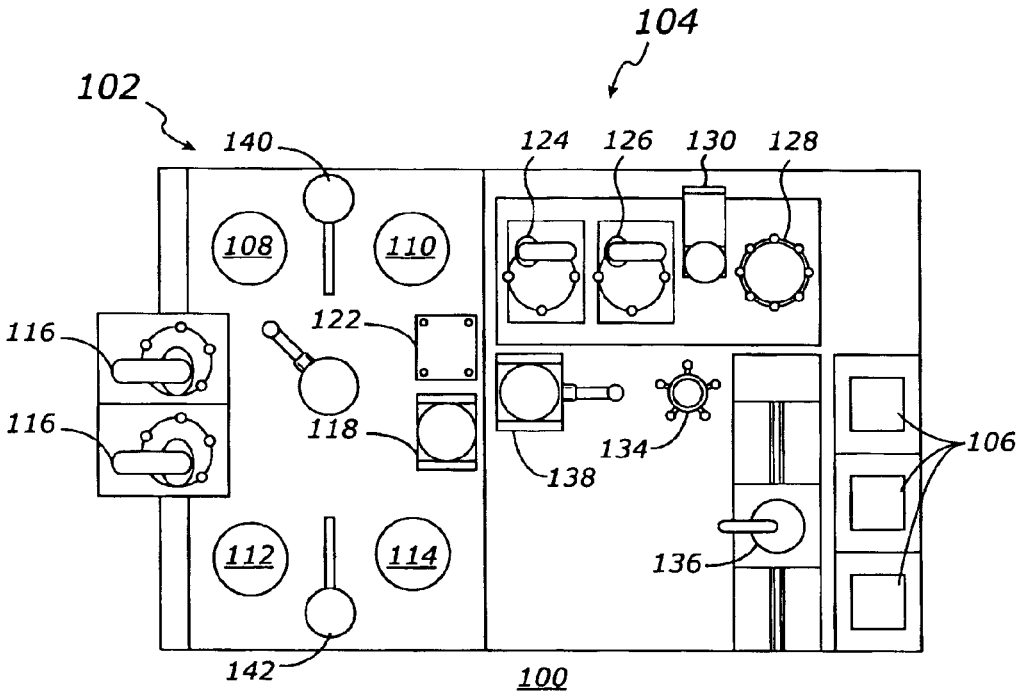
FIG. 2 is a top cutaway view of a polishing system in accordance with the present invention.

FIG. 2 illustrates a top cutaway view of a polishing apparatus 100, suitable for electrochemically depositing or planarizing conductive material on or from the surface of a workpiece in accordance with the present invention. The apparatus 100 includes a multi-station polishing system 102, a clean system 104, and a wafer load/unload station 106. In addition, the apparatus 100 includes a cover (not shown) that surrounds the apparatus 100 to isolate the apparatus 100 from the surrounding environment. In accordance with a preferred embodiment in the present invention, the apparatus 100 is a Momentum machine available from Novellus Systems, Inc. of Chandler, Ariz. However, the apparatus 100 may be any machine capable of removing or depositing material from or onto a workpiece surface.

Although the present invention may be used to remove material or deposit material on the surface of a variety of workpieces such as magnetic disks, optical disks, and the like, the invention is conveniently described below in connection with removing and depositing material on the surface of a wafer. In the context of the present invention, the term "wafer" shall mean semiconductor substrates, which may include layers of insulating, semiconductor, and conducting layers or features formed thereon and used to manufacture microelectronic devices.

An exemplary polishing station 102 includes four polishing stations, 108, 110, 112, and 114, that operate independently; a buff station 116; a stage 118; a robot 120; and optionally, a metrology station 122. Polishing stations 108–114 may be configured as desired to perform specific functions.

The polishing system 102 also includes polishing surface conditioners 140 and 142. The configuration of the conditioners 140 and 142 generally depends on the type of polishing surface to be conditioned. For example, when the polishing surface comprises a polyurethane polishing pad, conditioners 140 and 142 may include a rigid substrate coated with diamond material. Various other surface conditioners may also be used in accordance with the present invention.

The clean system 104 is generally configured to remove debris such as slurry residue and material from the wafer surface during polishing. In accordance with the illustrated embodiment, the system 104 includes clean stations 124 and 126, a spin rinse dryer 128, and a robot 130 configured to transport the wafer between the clean stations 124 and 126 and the spin rinse dryer 128. Alternatively, the clean station 104 may be separate from the remainder of the electrochemical deposition and planarization apparatus. In this case, the load station 106 is configured to receive dry wafers for processing, but the wafers may remain in a wet (e.g., deionized water) environment until the wafers are transferred to the clean station. In operation, cassettes 132, including one or more wafers, are loaded onto apparatus 100 at station 106. The wafers are then individually transported to a stage 134 using a dry robot 136. A wet robot 138 retrieves a wafer at the stage 134 and transports the wafer to metrology station 122 for film characterization or to the stage 118 within the polishing system 102. The robot 120 picks up the wafer from the metrology station 122 or the stage 118 and transports the wafer to one of the polishing stations 108–114 for electrochemical deposition or planarization of a conductive material. After a desired amount of material has been deposited or removed, the wafer may be transported to another polishing station. Alternatively, as will be more fully discussed below, a polishing environment within one of the stations may be changed from an environment suitable for the electrochemical deposition to an environment suitable for electrochemical planarization; e.g., by changing the solution and the bias applied to the wafer. In this case, a single polishing station may be used to both deposit material and remove material from the wafer.

After conductive material has been either deposited or removed from the wafer surface, the wafer is transferred to the buff station 116 to further polish the surface of the wafer. After the polishing and/or buff process, the wafer is transferred to the stage 118 which is configured to maintain one or more wafers in a wet (e.g. deionized water) environment.

After the wafer is placed on the stage 118, the robot 138 picks up the wafer and transports it to the clean system 104.

In particular, the robot 138 transports the wafer to the robot 130, which in turn places the wafer in one of the clean stations 124, 126. The wafer is there cleaned and then transported to the spin rinse dryer 128 to rinse and dry the wafer prior to transporting it to the load/unload station 106 using the robot 136.

Figure 3:
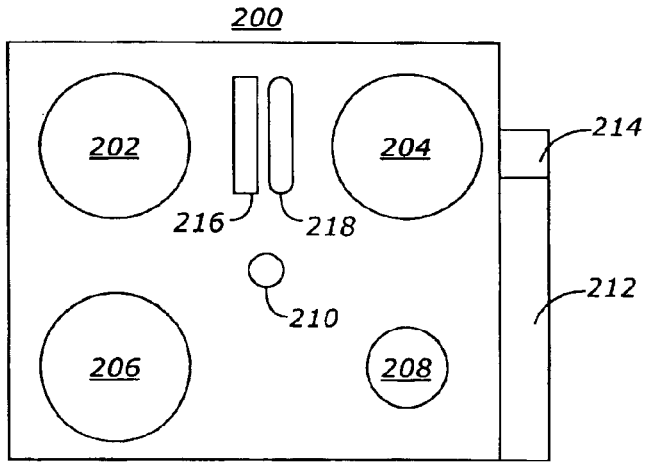
FIG. 3 is a top cutaway view of a portion of an electrochemical polishing apparatus in accordance with another embodiment of the present invention.
Figure 4:
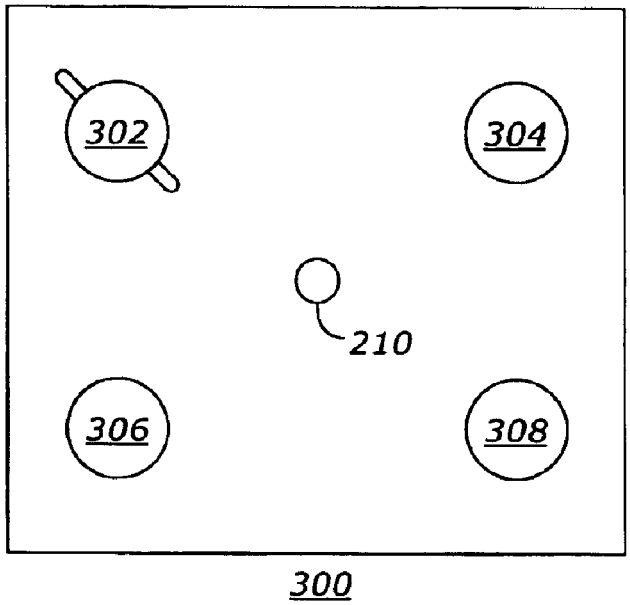
FIG. 4 is a bottom cutaway view of a carousel for use with the apparatus shown in FIG. 3.

FIG. 3 illustrates a top cut away view of another exemplary polishing apparatus 200, configured to electrochemically planarize, electrochemically deposit material onto a wafer, and polish the surface of a wafer to remove a portion of the deposited material. The apparatus 200 is suitably coupled to a carousel 300 illustrated in FIG. 4 to form an automated electrochemical deposition, planarization, and polishing system. The system in accordance with this embodiment may also include a removable cover (not shown) overlying the apparatus 200 and the carousel 300.

The apparatus 200 includes three polishing stations, 202, 204, and 206, a wafer transfer station 208, a center rotational post 210 that is coupled to carousel 300 and which operatively engages carousel 300 to cause carousel 300 to rotate, a load and unload station 212, and a robot 214 configured to transport wafers between stations 212 and 208. Furthermore, the apparatus 200 may include one or more rinse washing stations 216 to rinse and/or wash a surface of a wafer before or after a polishing, electrodeposition, or electroplanarization. Although illustrated with three polishing stations, the apparatus 200 may include any desired number of polishing stations, and one or more such polishing stations may be used to buff a surface of a wafer. Furthermore, the apparatus 200 may include an integrated wafer clean and dry system similar to the system 104 described above. The wafer station 208 is generally configured to stage wafers before or between polishing and/or buff operations and may be further configured to wash and/or maintain the wafers in a wet environment.

The carousel 300 includes polishing heads, or carriers, 302, 304, 306, and 308, each configured to hold a single wafer and urge the wafer against the polishing surface (e.g., a polishing surface associated with one of stations 202–206). Each carrier 302–308 is suitably spaced from the post 210 such that each carrier aligns with a polishing station or the wafer station 208. In accordance with one embodiment of the invention, each carrier 302–308 is attached to a rotatable drive mechanism using a Gimble system (not illustrated) which allows the carriers 302–308 to cause a wafer to rotate (e.g., during a polishing process). In addition, the carriers may be attached to a carrier motor assembly that is configured to cause the carriers to translate as, for example, along tracks 310. Furthermore, each carrier 302–308 may rotate and translate independently of the other carriers.

In operation, wafers are processed using the apparatus 200 and carousel 300 by loading a wafer onto the station 208 from the station 212 using the robot 214. When a desired number of wafers are loaded onto the carriers, at least one of the wafers is placed in contact with the polishing surface. The wafer may be positioned by lowering a carrier to place the wafer surface in contact with the polishing surface, or a portion of the carrier (e.g., a wafer holding surface) may be lowered to position the wafer in contact with the polishing surface. After polishing is complete, one or more conditioners 218 may be employed to condition the polishing surfaces.

Figure 5:
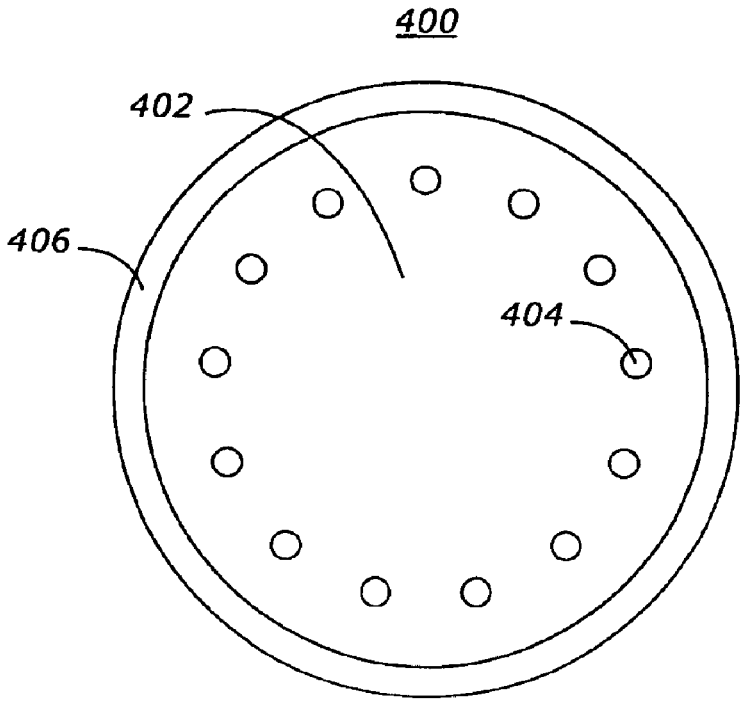
FIG. 5 is a top plan view of a typical workpiece carrier for use in conjunction with the inventive electrochemical deposition apparatus.

During a polishing process, a wafer may be held in place by a carrier 400, illustrated in FIG. 5. The carrier 400 comprises a retaining ring 406 and a receiving plate 402 including one or more apertures 404. The apertures 404 are designed to assist retention of a wafer by the carrier 400 by, for example, allowing a vacuum pressure to be applied to the backside of the wafer or by creating enough surface tension to retain the wafer. The retaining ring 406 limits the movement of the wafer during the polishing process.

Figure 6:
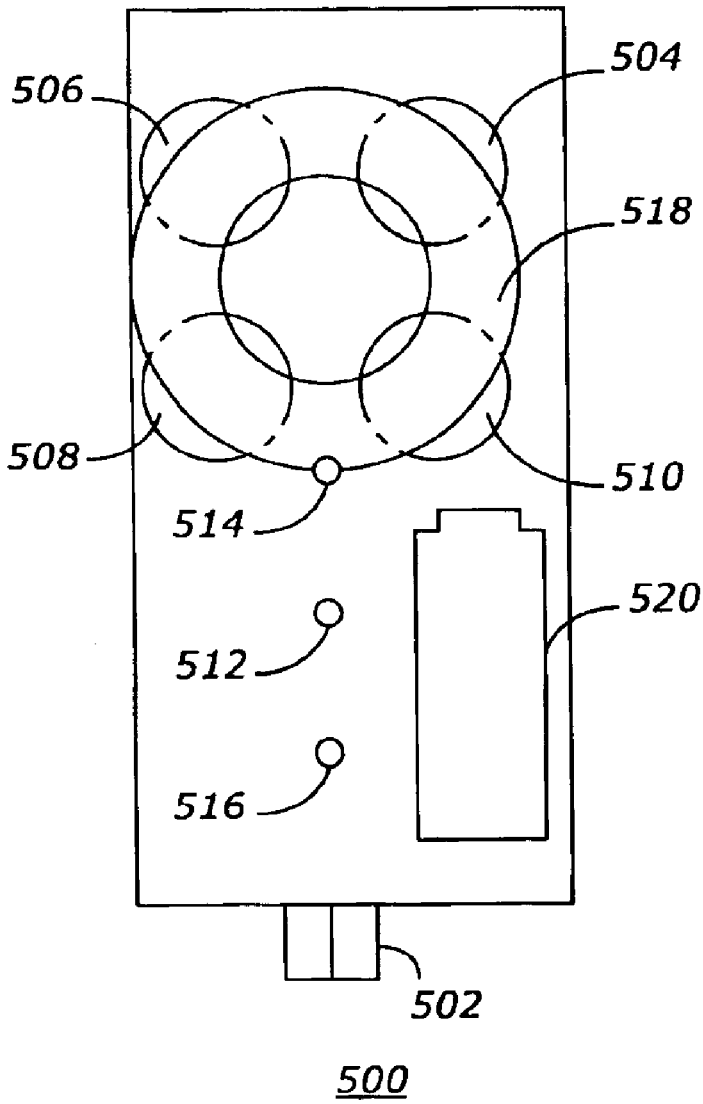
FIG. 6 is a top cutaway view of apportion of an electrochemical polishing apparatus in accordance with still another embodiment of the present invention.

FIG. 6 illustrates another polishing system 500 in accordance with the present invention. It is suitably configured to receive a wafer from a cassette 502 and return the wafer to the same or to a predetermined different location within the cassette in a clean common dry state. The system 500 includes polishing stations 504 and 506, a buff station 508, a head loading station 510, a transfer station 512, a wet robot 514, a dry robot 516, a rotatable index table 518, and a clean station 520. The dry robot 516 unloads a wafer from the cassette 502 and places the wafer on the transfer station 512. The wafer then travels to the polishing stations 504–508 for polishing and returns to the station 510 for unloading by the wet robot 514 and the transfer station 512. The wafer is then transferred to the clean system 520 to clean, rinse, and dry the wafer before the wafer is returned to the load and unload station 502 using the dry robot 516.

Figure 7:
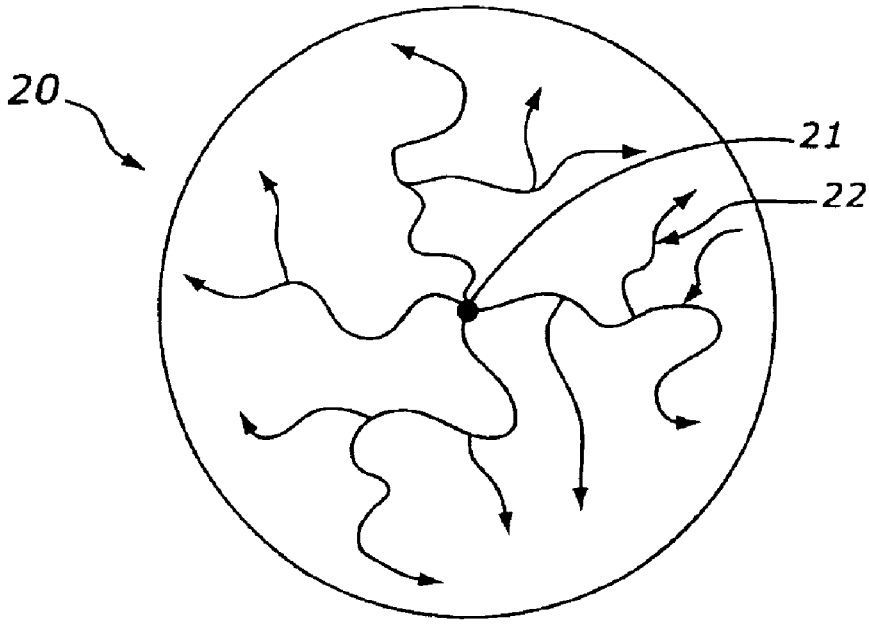
FIG. 7 is an elevational view of a platen that is to be joined with a CMP pad according to an embodiment of the invention.
Figure 8:
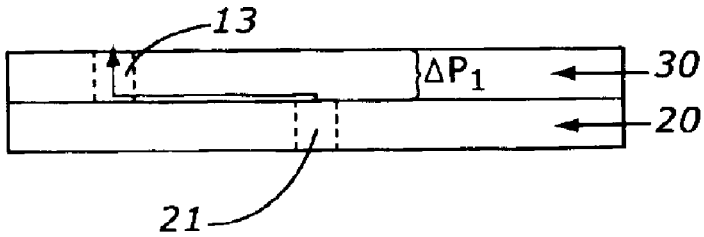
FIG. 8 is a side view of a platen together with a CMP pad according to an embodiment of the invention.

The fluid distribution system according to the present invention can be incorporated into any of the polishing stations described above. The fluid distribution system is divided into three sub-systems. The first distribution sub-system begins at a point where CMP slurry is introduced to a platen 20 through an inlet 21 as depicted in FIG. 7. The arrows in FIG. 7 represent a platen manifold system 22 through which the slurry flows. The first distribution sub-system ends at a point where the slurry reaches a delivery hole 13 in a CMP pad 30 as depicted in FIG. 8. Because the slurry passages in the platen manifold system 22 restrict free flow, there is a change in resistance when the slurry leaves the manifold system 22 and enters the pad delivery hole 13. The change in resistance as the slurry passes through the manifold system 22, from the inlet 21 to the pad delivery hole 13 ("manifold pressure drop") is represented by $\Delta P_1$ and the corresponding slurry pathway is designated by the arrow in FIG. 8.

Figure 9:
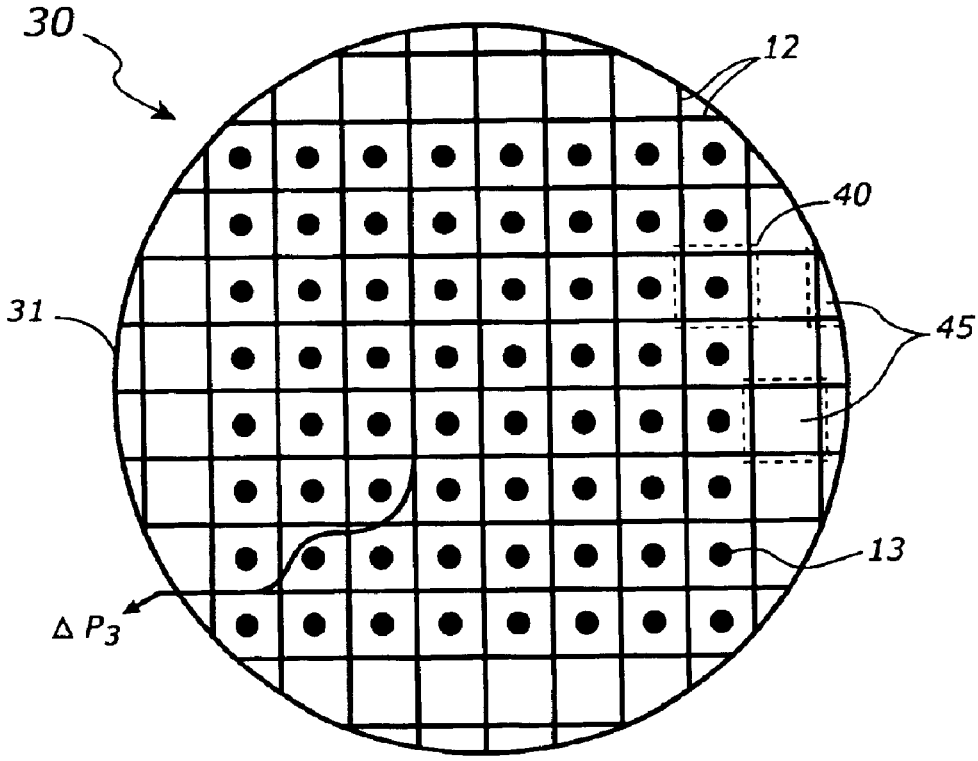
FIG. 9 is an elevational view of a CMP pad according to an embodiment of the present invention.
Figure 10:
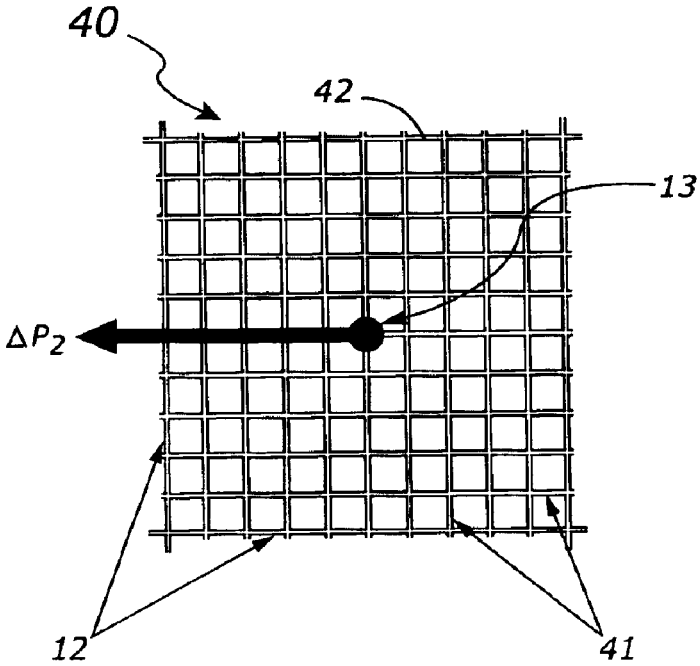
FIG. 10 is an elevational view of a land that forms part of a CMP pad according to one embodiment of the invention.

The second distribution sub-system is best understood by first describing the individual land areas 40, 45 depicted in FIGS. 9 and 10. All the land areas 40, 45 have edges 42 that are defined either by perimeter grooves 12 or by the CMP edge 31. The land areas 40, 45 include grooves 41 that are smaller than the perimeter grooves 12 in terms of their cross section areas. The land area grooves 41 can consist of various geometric shapes that meet at arbitrary angular orientations with the perimeter grooves 12. The second distribution sub-system begins at a point where slurry is delivered to the land area grooves 41. The slurry delivery holes 13 are major delivery points for land areas 40 that include such delivery holes 13. The slurry has a natural tendency to flow to areas of lesser resistance, and the second delivery system ends as the slurry is forced from the land area grooves 41 either into the perimeter grooves 12 or off of the CMP pad edge 31. The change in resistance as the slurry passes from the land area grooves 41 to either the perimeter grooves 12 or off of the CMP edge 31 ("land pressure drop") is represented by $\Delta P_2$, and the corresponding slurry pathway is designated by the arrow in FIG. 10.

The third distribution sub-system consists of the perimeter grooves 12. Once slurry is introduced into the perimeter grooves 12, pressure potential and resistance forces force the slurry toward the CMP pad edge 31. The change in resistance as the slurry passes off the CMP edge 31 from the perimeter grooves 12 ("exhaust pressure drop") is represented by $\Delta P_3$, and the corresponding slurry pathway is designated by the arrow in FIG. 9.

An important aspect of the present invention lies in the discovery that uniform slurry distribution across a CMP pad, particularly a CMP pad having a perimeter based exhaust system such as the one depicted in FIG. 10, can be achieved by maximizing the ratio $\Delta P_2/\Delta P_3$ between the land pressure drop and the exhaust pressure drop, and the ratio $\Delta P_2/\Delta P_1$ between the land pressure drop and the manifold pressure drop. These ratios are most easily maximized by constructing the land area grooves 41 to have a high degree of fluid resistance in comparison with the manifold system and perimeter grooves.

According to an exemplary embodiment of the invention, high fluid resistance is governed by controlling the relationship between the land area groove cross sectional area and the perimeter groove cross sectional area. The land area grooves 41 must have cross sectional areas that are smaller than those of the perimeter grooves 12 according to this embodiment. As the land area groove cross sectional area decreases, the land pressure drop $\Delta P_2$ increases. Consequently, a simple way to make the land pressure drop $\Delta P_2$ higher than the exhaust pressure drop $\Delta P_3$ is to form the land area grooves 41 with depths that are uniformly smaller than the perimeter groove depths, and with widths that are uniformly smaller than the perimeter groove widths.

Another aspect of this embodiment of the invention includes arranging the land area grooves 41 as parallel rows and parallel columns, with the rows and columns intersecting at perpendicular angles. The perimeter grooves 12 are also arranged as parallel rows and parallel columns that intersect at perpendicular angles. The perimeter grooves 12 define complete squares that surround each interiorly-located land 40, and partial squares that partially surround each land 45 disposed at the perimeter of the CMP pad. The perimeter grooves 12 in this arrangement are hereinafter referred to as "the X-Y grooves," and the land area grooves 41 in this arrangement are hereinafter referred to as "the sub X-Y grooves."

According to this embodiment of the invention, the X-Y grooves are spaced at a pitch between 1.0 inch and 1.375 inch. Each of the lands that are entirely surrounded by the X-Y grooves includes between about 7 and about 16 sub X-Y grooves in one direction and between about 7 and about 16 sub X-Y grooves in a perpendicular direction.

The X-Y groove width can range between about 0.032 inch and about 0.037 inch, and the X-Y groove depth can range between about 0.055 inch and about 0.060 inch. The sub X-Y groove width can range between about 0.010 inch and about 0.014 inch, and the sub X-Y groove depth can range between about 0.020 inch and about 0.025 inch.

EXAMPLE

A CMP pad (0.080 inch thick, ~416 mm in diameter) of X-Y grooves and sub-X-Y grooves was manufactured and the pad's performance was tested by polishing and examining 300 mm semiconductor wafers. The X-Y grooves were disposed 1 inch apart, and measured 0.035 inch wide and 0.060 inch deep, the cross sectional area therefore being 0.0021 $inch^2$. Each 1 $inch^2$ land formed by the X-Y grooves included a 7×7 grid of evenly spaced sub X-Y grooves. The sub X-Y grooves measured 0.010 inch wide and 0.020 inch deep, the cross sectional area therefore being 0.00020 $inch^2$. With the X-Y grooves having a cross sectional area more than 10× that of the sub X-Y grooves, the ratio $\Delta P_2/\Delta P_3$ between the land pressure drop and the exhaust pressure drop caused slurry distribution to readily flow from the sub X-Y grooves into the X-Y grooves.

Further, the CMP pad top surface becomes thinner over time due to wear. Nearly all of the CMP pad wear is associated with CMP pad conditioning that is intermittently performed on the CMP pad after polishing about 50 wafers. Only a negligible amount of CMP pad thinning is attributed to friction from wafer processing. As the CMP pad top surface thins, the ratio $\Delta P_2/\Delta P_3$ between the land pressure drop and the exhaust pressure drop increases because the sub X-Y groove cross sectional area is reduced at a greater rate than the X-Y groove cross sectional area.

Figure 11:
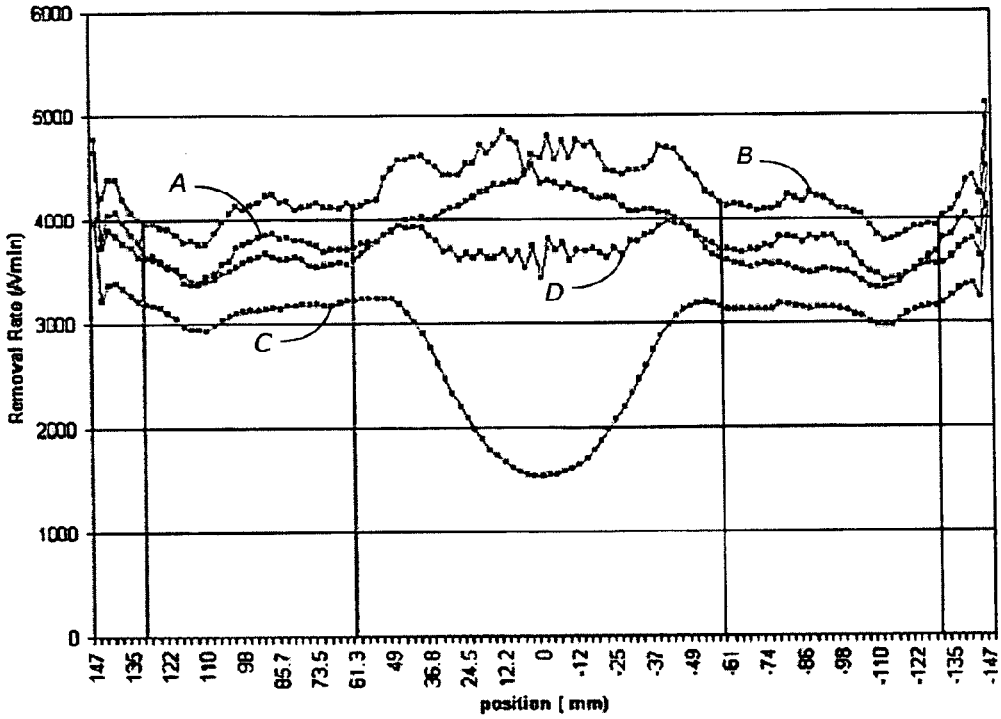
FIG. 11 is a graphical illustration of wafer removal rates measured at various distances from the wafer center according to various hole plugging schemes.

CMP wafer metrics track two important measurements: wafer non-uniformity and removal rate. Non-uniformity is positively correlated with slurry distribution across the CMP pad. This correlation is illustrated in FIG. 11, which is a graph of wafer removal rate (Å/min) measured at various distances from the wafer center. The wafer removal rate was determined by measuring the wafer thickness before and after polishing, and dividing the change in wafer thickness by the polishing time. There are four data sets in FIG. 11. The measurements of set A were made across the wafer diameter, with position "0 mm" being the wafer center, after polishing the wafer with a CMP pad having none of the 137 pad delivery holes plugged. The measurements of sets B, C, and D were made in an identical manner, with the only difference being the type of CMP pad used to polish the wafers. In set B, the center 81 holes were left open and the remaining 56 holes were plugged. In set C, the center 9 holes were plugged and the remaining 128 holes were left open. In set D, the center 49 holes were left open and the remaining 88 holes were plugged. The data sets in FIG. 11 clearly show how deprivation of slurry flow from certain areas of the CMP pad resulted in significant non-uniformity across the polished semiconductor wafers. When the slurry was only introduced to the CMP pad away from the CMP pad center (set C) the wafer material was removed from the wafer centers at a relatively slow rate, resulting in wafers that had a lower removal rate toward the center. Conversely, when the slurry was introduced to the CMP pad toward the CMP pad center (sets B and D) the wafer material was removed from the wafer centers at a relatively high rate, resulting in wafers that thinned toward the center.

Figure 1A:
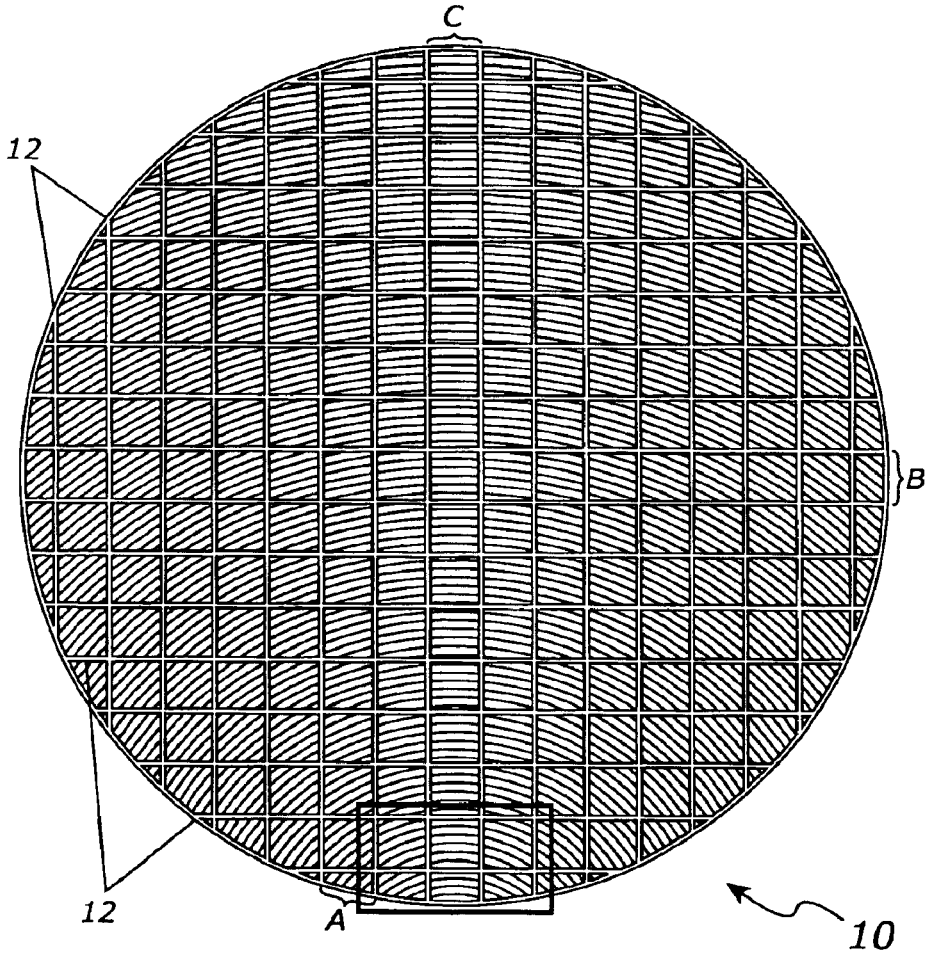
FIGS. 1(A) and 1(B) are elevational views of a CMP pad that is known in the art, with FIG. 1(B) being a magnified view of a CMP pad segment.
Figure 1B:
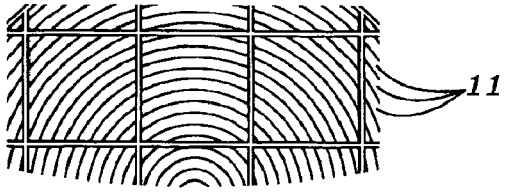
Figure 12:
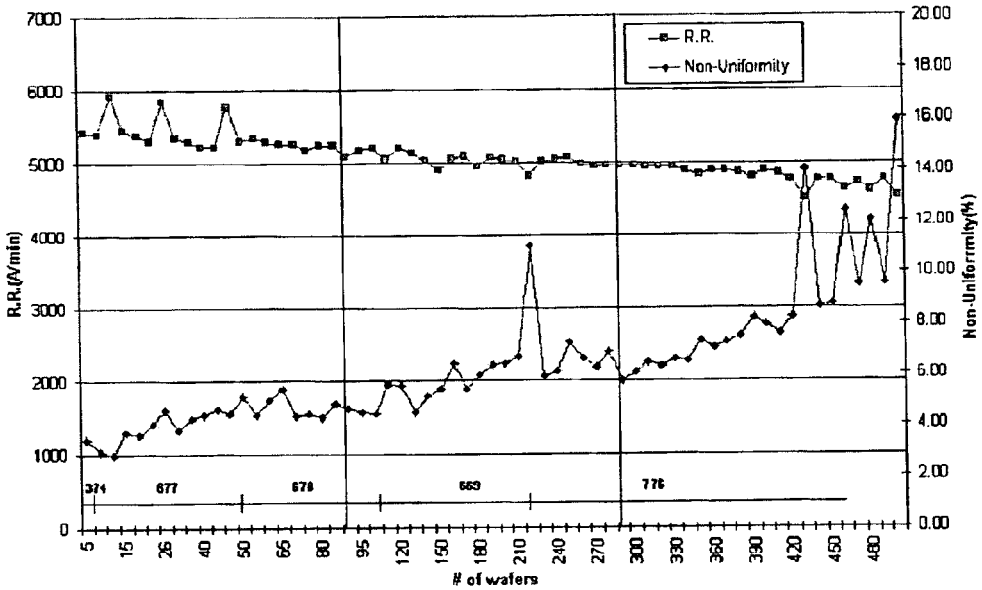
FIG. 12 is a graphical illustration of wafer removal rates using a contemporary CMP pad.
Figure 13:
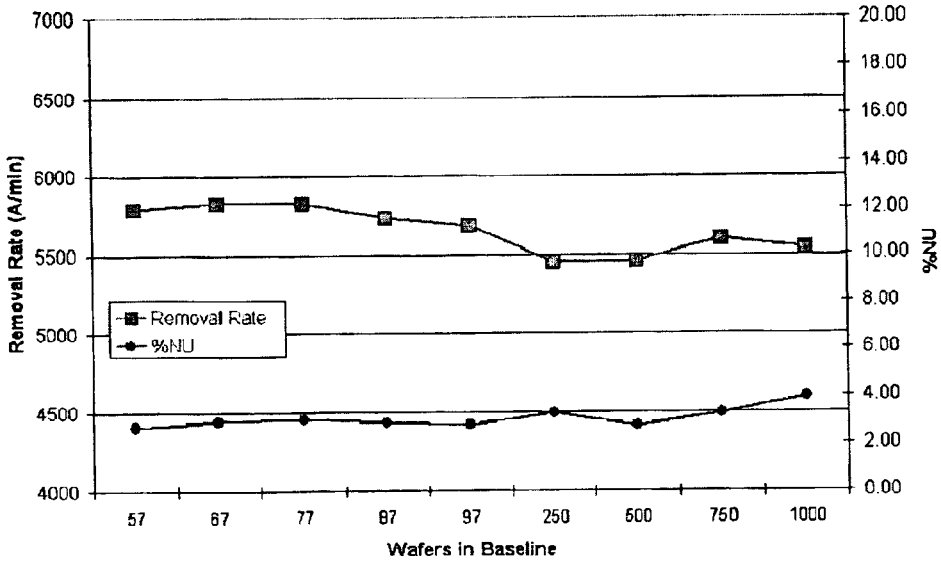
FIG. 13 is a graphical illustration of wafer removal rates using a CMP pad according to one embodiment of the invention.

FIGS. 12 and 13 graphically compare removal rates and non-uniformity for wafers prepared using a conventional CMP pad (FIG. 12) and using the CMP pad of X-Y grooves and sub X-Y grooves (FIG. 13). While wafer non-uniformity is directly correlated with and primarily influenced by slurry distribution across the CMP pad, the average removal rate for the wafer as a whole is a function of several highly influential variables, including the polish pressure, polish speed, slurry composition, and CMP pad conditioning. During the tests summarized in FIG. 13, the polish pressure, polish speed, and slurry composition were constants, and wafers were polished on a CMP pad at various pad conditioning baseline levels ranging between 0 and 1000 wafers. The data in FIG. 12 for polishing using a contemporary CMP pad such as that depicted in FIG. 1 was recorded using the same testing conditions used for the tests summarized in FIG. 13, although the comparative data only spans a 500 wafer baseline.

The data summarized in FIGS. 12 and 13 reveal that the wafer removal rate for the CMP pad with X-Y and sub X-Y grooves was ~5500 Å/min after pad conditioning representing 1000 polished wafers. In contrast, the wafer removal rate for a conventional CMP pad conditioned to represent only 500 polished wafers was approaching ~4500 Å/min. Further, the non-uniformity data for the CMP pad with X-Y and sub X-Y grooves reveal wafer non-uniformity approaching 4% after pad conditioning representing 1000 polished wafers. This is a great improvement to the wafer non-uniformity between 8 and 16% for the conventional CMP pad conditioned to represent only 500 polished wafers.

The data from FIGS. 12 and 13 establish how slurry distribution is greatly improved using the CMP pad with X-Y and sub X-Y grooves according to an exemplary embodiment of the present invention, and the marked improvement in removal rate and uniformity for wafers produced by the CMP pad. The CMP pad of the present invention is also easily manufactured with little or no additional cost relative to conventional CMP pads.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A chemical-mechanical polishing assembly, comprising:

a platen having an outer edge, a top surface, and at least one inlet for introducing fluid to said top surface;

a manifold system, entrenched in said top surface and in communication with said at least one inlet, for channeling said fluid about said top surface;

a polishing pad disposed over said top surface and having a top pad surface and a plurality of fluid delivery through-holes for introducing said fluid from said manifold system to said top pad surface; and a fluid distribution system, entrenched in said top pad surface and in communication with said through-holes, for substantially uniformly distributing said fluid about said top pad surface, said fluid distribution system comprising:

a set of first grooves intersecting at right angles and collectively defining an array of lands, each of said first grooves having a first cross sectional area, and a plurality of second grooves intersecting at right angles and further communicating with said first grooves at right angles, each of said second grooves being disposed within one of the lands and having a second cross sectional area that is smaller than said first cross sectional area.

2. A chemical-mechanical polishing assembly according to claim 1, wherein said first grooves are evenly spaced across said top pad surface at a pitch between about 1.0 inch and about 1.375 inch, and said second grooves are evenly spaced across said lands.

3. A chemical-mechanical polishing assembly according to claim 2, wherein said array of lands consists of a first set of lands that are entirely surrounded by said first grooves, and a second set of land that are partially surrounded by said first grooves and form part of said outer edge, and each of said lands in said first set includes between about seven and about sixteen of said second grooves in a first direction, and between about seven and about sixteen of said second grooves in a second direction perpendicular to said first direction.

4. A chemical-mechanical polishing assembly according to claim 1, wherein each of said second grooves has a depth ranging between about 0.020 inch and about 0.025 inch, and a width ranging between about 0.010 inch and about 0.014 inch.

5. A chemical mechanical polishing assembly according to claim 1, wherein each of said first grooves has a depth ranging between about 0.055 inch and about 0.060 inch, and a width ranging between about 0.032 inch and about 0.030 inch.

6. A chemical-mechanical polishing assembly according to claim 1, wherein each of said through-holes is disposed within one of said lands with no more than one through-hole per land, thereby enabling said fluid to flow from said through-holes immediately into said second grooves.

7. A chemical-mechanical polishing assembly according to claim 1, comprising:

a platen having an outer edge, a top surface, and at least one inlet for introducing fluid to said top surface;

a manifold system, entrenched in said top surface and in communication with said at least one inlet, for channeling said fluid about said top surface;

a polishing pad disposed over said top surface and having a top pad surface and a plurality of fluid delivery through-holes for introducing said fluid from said manifold system to said top pad surface; and a fluid distribution system, entrenched in said top pad surface and in communication with said through-holes, for substantially uniformly distributing said fluid about said top pad surface, said fluid distribution system comprising:

a set of intersecting first grooves defining an away of lands, each of said first grooves having a first cross sectional area, and a plurality of second grooves disposed within said lands and communicating with said first grooves, each of said second grooves having a second cross sectional area that is smaller than said first cross sectional area, wherein said first and second grooves and said manifold system are configured to satisfy the ratios:

$$\Delta P_2/\Delta_3>1 \quad (1)$$

$$\Delta P_2/\Delta_1>1 \quad (2)$$

wherein $\Delta P_1$ is a drop in resistance pressure as said fluid flows from said manifold system to said through-holes, $\Delta P_2$ is a drop in resistance pressure as said fluid flows from said through holes through said second grooves to said first grooves, and $\Delta P_3$ is a drop in resistance pressure as said fluid flows through said first grooves off of said outer edge.

8. A chemical-mechanical polishing assembly according to claim 7, wherein the ratio:

$$\Delta P_2/\Delta P_3 \quad (1)$$

is at least 10.

9. A chemical-mechanical polishing pad, comprising:

a top surface;

a plurality of fluid delivery through-holes for introducing a fluid to said top surface; and a fluid distribution system, entrenched in said top surface and in communication with said through-holes, for substantially uniformly distributing said fluid about said top surface, said fluid distribution system comprising:

a set of first grooves intersecting at right angles and collectively defining an array of lands, each of said first grooves having a first cross sectional area, and a plurality of second grooves intersecting at right angles and further communicating with said first grooves at right angles, each of said second grooves being disposed within one of the lands and having a second cross sectional area that is smaller than said first cross sectional area.

10. A chemical-mechanical polishing pad according to claim 9, wherein said first grooves are evenly spaced across said top pad surface at a pitch between about 1.0 inch and about 1.375 inch, and said second grooves are evenly spaced across said lands.

11. A chemical-mechanical polishing pad according to claim 10, wherein said array of lands consists of a first set of lands that are entirely surrounded by said first grooves, and a second set of land that are partially surrounded by said first grooves and form part of said outer edge, and each of said lands in said first set includes between about 7 and about 16 of said second grooves in a first direction, and between about 7 and about 16 of said second grooves in a second direction perpendicular to said first direction.

12. A chemical-mechanical polishing pad according to claim 9, wherein each of said second grooves has a depth ranging between about 0.020 inch and about 0.025 inch, and a width ranging between about 0.010 inch and about 0.014 inch.

13. A chemical-mechanical polishing pad according to claim 11, wherein each of said first grooves has a depth ranging between about 0.055 inch and about 0.060 inch, and a width ranging between about 0.032 inch and about 0.030 inch.

14. A chemical-mechanical polishing pad according to claim 9, wherein each of said through-holes is disposed within one of said lands with no more than one through-hole per land, thereby enabling said fluid to flow from said through-holes immediately into said second grooves.

15. A chemical-mechanical polishing assembly according to claim 1, comprising:

a top surface;

a plurality of fluid delivery through-holes for introducing a fluid to said pad surface; and a fluid distribution system, entrenched in said top surface and in communication with said through-holes, for substantially uniformly distributing said fluid about said top surface, said fluid distribution system comprising:

a set of intersecting first grooves defining an array of lands, each of said first grooves having a first cross sectional area, and a plurality of second grooves disposed within said lands and communicating with said first grooves, each of said second grooves having a second cross sectional area that is smaller than said first cross sectional area, wherein said first and second grooves are configured to satisfy the ratio:

$$\Delta P_2/\Delta P_3>1 \quad (1)$$

wherein $\Delta P_2$ is a drop in resistance pressure as said fluid flows from said through holes through said second grooves to said first grooves, and $\Delta P_3$ is a drop in resistance pressure as said fluid flows through said first grooves off of said outer edge.

16. A chemical-mechanical polishing assembly according to claim 15, wherein the ratio:

$$\Delta P_2/\Delta P_3 \quad (1)$$

is at least 10.

17. A chemical-mechanical polishing apparatus for planarizing a workpiece surface, comprising:

a platen having an outer edge, a top surface, and at least one inlet for introducing fluid to said top surface;

a manifold system, entrenched in said top surface and in communication with said at least one inlet, for channeling said fluid about said top surface;

a polishing pad disposed over said top surface and having a top pad surface and a plurality of fluid delivery through-holes for introducing said fluid from said manifold system to said top pad surface;

a fluid distribution system, entrenched in said top pad surface and in communication with said through-holes, for substantially uniformly distributing said fluid about said top pad surface, said fluid distribution system comprising:

a set of first grooves intersecting at right angles and collectively defining an array of lands, each of said first grooves having a first cross sectional area, and a plurality of second grooves intersecting at right angles and further communicating with said first grooves at right angles, each of said second grooves being disposed within one of the lands and having a second cross sectional area that is smaller than said first cross sectional area; and a carrier configured to carry and press said workpiece against said polishing pad.

18. A chemical-mechanical polishing apparatus according to claim 17, wherein said first grooves are evenly spaced across said top pad surface at a pitch between about 1.0 inch and about 1.375 inch, and said second grooves are evenly spaced across said lands.

19. A chemical-mechanical polishing apparatus according to claim 18, wherein said array of lands consists of a first set of lands that are entirely surrounded by said first grooves, and a second set of land that are partially surrounded by said first grooves and form part of said outer edge, and each of said lands in said first set includes between about seven and about sixteen of said second grooves in a first direction, and between about seven and about sixteen of said second grooves in a second direction perpendicular to said first direction.

20. A chemical-mechanical polishing apparatus according to claim 17, wherein each of said second grooves has a depth ranging between about 0.020 inch and about 0.025 inch, and a width ranging between about 0.010 inch and about 0.014 inch.

21. A chemical-mechanical polishing apparatus according to claim 17, wherein each of said first grooves has a depth ranging between about 0.055 inch and about 0.060 inch, and a width ranging between about 0.032 inch and about 0.030 inch.

22. A chemical-mechanical polishing apparatus according to claim 17, wherein each of said through-holes is disposed within one of said lands with no more than one through-hole per land, thereby enabling said fluid to flow from said through-holes immediately into said second grooves.

23. A chemical-mechanical polishing apparatus according to claim 17, comprising:

a platen having an outer edge, a top surface, and at least one inlet for introducing fluid to said top surface;

a manifold system, entrenched in said top surface and in communication with said at least one inlet, for channeling said fluid about said top surface;

a polishing pad disposed over said top surface and having a top pad surface and a plurality of fluid delivery through-holes for introducing said fluid from said manifold system to said top pad surface;

a fluid distribution system, entrenched in said top pad surface and in communication with said through-holes, for substantially uniformly distributing said fluid about said top pad surface, said fluid distribution system comprising:

a set of intersecting first grooves defining an array of lands, each of said first grooves having a first cross sectional area, and a plurality of second grooves disposed within said lands and communicating with said first grooves, each of said second grooves having a second cross sectional area that is smaller than said first cross sectional area; and a carrier configured to carry and press said workpiece against said polishing pad, wherein said first and second grooves and said manifold system are configured to satisfy the ratios:

$$\Delta P_2/\Delta P_3>1 \quad (1)$$

$$\Delta P_2/\Delta P_1>1 \quad (2)$$

wherein $\Delta P_1$ is a drop in resistance pressure as said fluid flows from said manifold system to said through-holes, $\Delta P_2$ is a drop in resistance pressure as said fluid flows from said through holes through said second grooves to said first grooves, and $\Delta P_3$ is a drop in resistance pressure as said fluid flows through said first grooves off of said outer edge.

24. A chemical-mechanical polishing apparatus according to claim 23, wherein the ratio:

$$\Delta P_2/\Delta P_3 \quad (1)$$

is at least 10.

* * * * *